United States Patent [19]

Tolentino

[11] Patent Number: 4,511,040

[45] Date of Patent: Apr. 16, 1985

[54] DISPLAY CASE

[75] Inventor: John Tolentino, Muskego, Wis.

[73] Assignee: Chicago Cutlery Consumer Products, Inc., Minneapolis, Minn.

[21] Appl. No.: 482,923

[22] Filed: Apr. 7, 1983

[51] Int. Cl.[3] ..... B65D 1/22; A47F 7/00

[52] U.S. Cl. ..... 206/553; 206/44.11; 206/45.34; 211/70.6; 248/37.6

[58] Field of Search ..... 206/44.11, 45.34, 553; 211/60 R, 60 T, 70.6; 248/113, 37.3, 37.6

[56] References Cited

U.S. PATENT DOCUMENTS

| | | | |
|---|---|---|---|
| 59,181 | 10/1866 | Carrier | 211/70.6 |
| 255,686 | 3/1882 | Simons et al. | 312/128 |
| 363,619 | 5/1887 | Flagg | 312/118 |
| 541,111 | 6/1895 | McDonald | 217/10 |
| 646,012 | 3/1900 | Strow et al. | 211/123 |
| 676,573 | 6/1901 | Bowers | 211/70.6 |
| 764,529 | 7/1904 | Ingalls | 312/118 |
| 926,852 | 7/1909 | Catlin | 248/37.3 |
| 1,714,960 | 5/1929 | Koss | 266/152 |
| 2,069,528 | 5/1935 | Kress | 211/69 |
| 2,089,537 | 8/1937 | Champlin | 248/37.6 |
| 2,311,932 | 2/1943 | Deckard | 211/60 S |
| 2,338,303 | 1/1944 | Rosenberg | 248/37.6 |
| 2,340,521 | 2/1944 | Engert | 248/312 |
| 2,488,664 | 11/1949 | Gruber | 211/60 R |
| 2,609,921 | 9/1952 | Naken | 206/553 |
| 2,738,076 | 3/1956 | Porter | 211/60 S |
| 2,943,745 | 7/1960 | Bjornson | 211/60.1 |
| 3,056,412 | 10/1962 | Wolfe | 211/60.1 |
| 3,102,637 | 9/1963 | Scholl | 211/69 |
| 3,438,506 | 4/1969 | Groth | 211/4 |
| 4,194,637 | 3/1980 | Edson | 211/59.1 |
| 4,372,468 | 2/1983 | Harvey | 211/70.6 |
| 4,405,108 | 9/1983 | Muirhead | 211/60 T |

FOREIGN PATENT DOCUMENTS

| | | | |
|---|---|---|---|
| 654909 | 1/1963 | Canada | 211/70.7 |
| 115899 | 7/1926 | Switzerland | 248/113 |
| 954608 | 4/1964 | United Kingdom | 206/553 |

OTHER PUBLICATIONS

Advertising Brochures, Chicago Cutlery, (two pages).

*Primary Examiner*—William T. Dixson, Jr.
*Assistant Examiner*—Brenda J. Ehrhardt
*Attorney, Agent, or Firm*—Allegretti, Newitt, Witcoff & McAndrews, Ltd.

[57] ABSTRACT

A compact case for displaying and storing cutlery or related articles. The case includes a container with a forward display portion and a rear storage portion, separated by a divider. A series of storage blocks for carrying cutlery are positioned within the rear storage portion, and cutlery support frames are mounted on the divider. Each cutlery support frame includes a vertical backplate with a horizontal tab extending therefrom. A support clip is pivotally attached by one end to each backplate. The storage blocks are elongated blocks having a plurality of thin slots oriented transverse to the longer side of each block, and further having a plurality of passageways parallel to the slots. The blocks also have a plurality of tabs extending from the block between the slots and parallel to the slots, with the tabs tapering away from the slots to form a guide for cutlery handles.

6 Claims, 12 Drawing Figures

Fig. 8
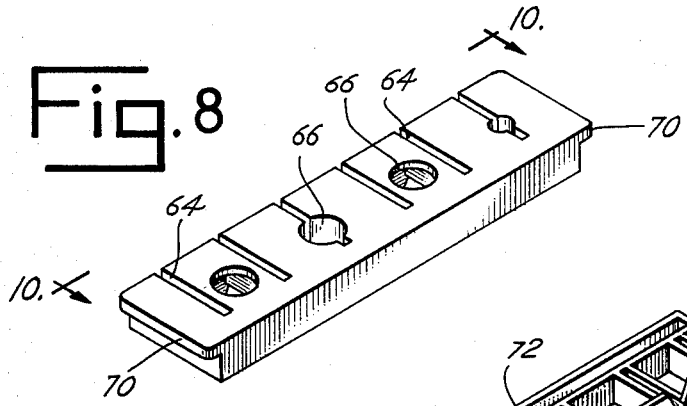
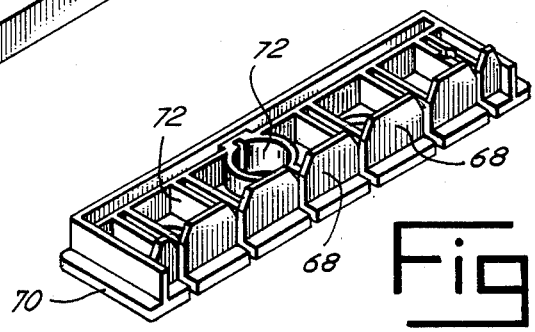
Fig. 9
Fig. 10
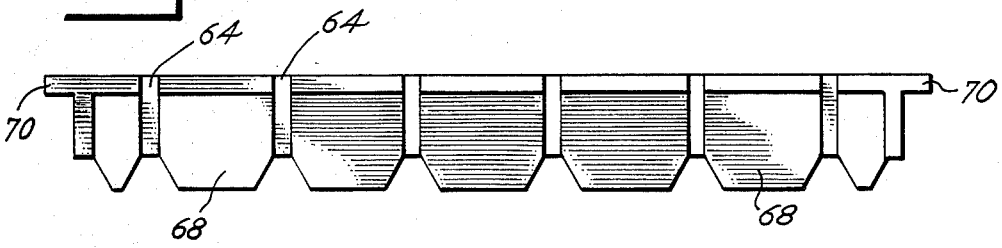
Fig. 11
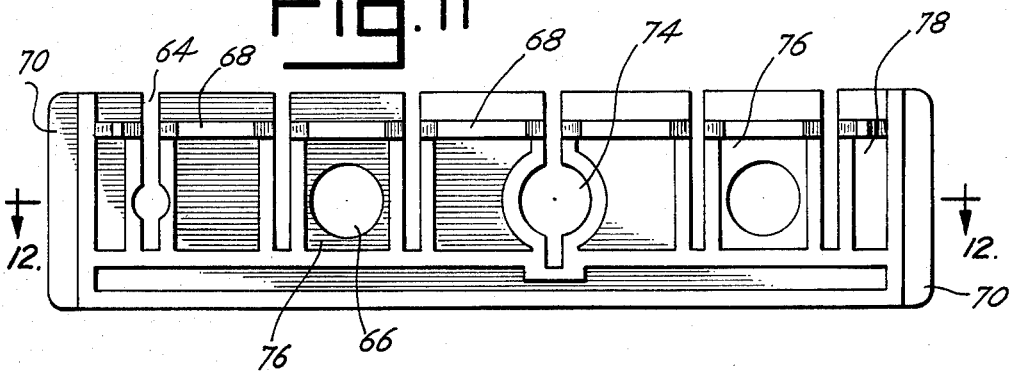
Fig. 12
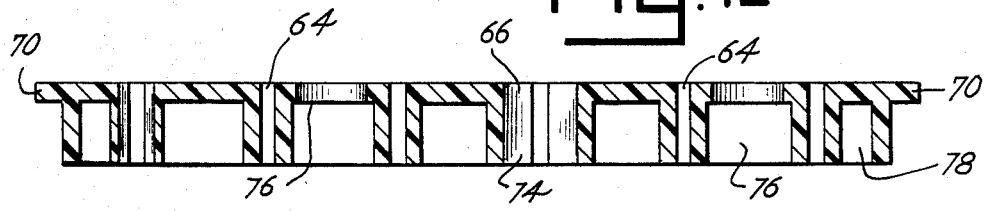

DISPLAY CASE

BACKGROUND OF THE INVENTION

This invention relates to cases for storing and displaying retail sale articles, and more particularly relates to a construction for displaying and securely storing a variety of cutlery to be sold in a retail sales outlet.

Modern retail stores, particularly small specialty retail outlets, typically have limited space and limited resources for the production and use of display materials. Accordingly, such marketing and display materials are often developed and prepared by the manufacturers or distributors of the items sold in the retail outlets. Nevertheless, retail outlets are still faced with problems involving storage of retail stock, security of the stock and displayed items against theft, and limited space for displays.

The storage and display problems faced by retail outlets are particularly acute when the merchandise to be stocked and displayed consists of cutlery and related items having sharp edges and points. Such merchandise must be displayed and handled with special care, so that neither customers nor employees of the retail establishment suffer injuries. Customers must also have an unobstructed view of the entire selection of cutlery, and must be able to handle sample items of cutlery easily and safely. Moreover, the nondisplayed stock ideally should be stored within easy reach of the displayed stock, so that customers are not inconvenienced by long delays and excessive searching by stock clerks for the chosen item, after the customer has made his slection.

In the prior art, cutlery merchandise has been displayed separately from its storage, and in ways that are inconvenient to potential customers. To minimize the chance of injury to customers, displayed cutlery merchandise is often individually wrapped, or permanently mounted on a display board. Occasionally, displayed cutlery is placed in a knifeblock, preventing that cutlery from being viewed in its entirety without being withdrawn from the block. Knifeblocks also allow only a limited slection of cutlery to be displayed because the knifeblock slots are typically provided in onely a few sizes, and unusual items, such as sharpening tools, cannot normally be placed within a knifeblock. Permanent mountings of knives, or individual wrapping of cutlery, allows display of entire cutlery items, and provides for greater safety of the customer, but does not allow a customer to individually handle each item of cutlery if he so chooses.

Storage of retail cutlery merchandise has also presented problems in the past. Such items are normally produced in a wide variety of configurations, and are sold along with support items, such as sharpening tools, that take on shapes and configurations greatly different from cutlery. Storage of such a variety presents difficulties, both in minimizing the space occupied by the storage, and in preventing injury from sharp cutlery implements. Storage of cutlery in boxes, storage in knifeblocks, and storage of cutlery by hanging it by hooks, all present difficulties, because those methods have limited flexibility, complexity, lack of versatility, and limited safety.

Accordingly, it is an object of this invention to provide a compact merchandise display case with an integral storage feature.

Another object of this invention is to provide a cutlery display case with a simple system for removably displaying cutlery items.

A further object of this invention is to provide a display mechanism in a display case that is adaptable to a variety of cutlery items, and to a variety of display configurations.

Another object of this invention is to provide a cutlery display case that safely displays cutlery items while allowing individual items of cutlery to be handled and evaluated by potential customers.

Yet another object of this invention is to provide a cutlery display case with an integral stock storage adaptable to a variety of cutlery configurations and merchandise storage positions.

A further object of this invention is to provide a merchandise display and storage case with a secure means of storing the stock of cutlery merchandise.

Another object of this invention is to provide a cutlery storage and display case capable of providing information regarding the cutlery displayed and stored.

Yet another object of this invention is to provide a merchandise display and storage case capable of storing and displaying a variable mix of stock and displayed cutlery.

Still another object of this invention is to provide a merchandise display and storage case having a single support structure adaptable to a variety of cutlery.

SUMMARY OF THE INVENTION

These and other objects of the invention are achieved by providing a compact stocking and display container. A principal aspect of the invention comprises a forward display portion and a rearward storage portion, a divider between the forward and rearward portions, a means for carrying cutlery in the storage portion, the means being adaptable to various configurations of cutlery, and a means for supporting cutlery on the divider. The cutlery is supported on the divider through use of a cutlery receptacle, including a bracket with a generally vertical backplate and a generally horizontal positioning tab, and a support clip pivotally attached at one end of the bracket and hanging from the bracket by the pivotally attached end, so that the cutlery is supported by the support clip and rests against the bracket. The support frame is attached to the divider through use of a groove in the rear of the support frame complementary to a tongue affixed to the divider. Storage in the display case is provided by at least one cutlery storage block, that block being slidably insertable into the display case, and having a plurality of slots and passageways in a variety of shapes through which cutlery and related items can be inserted. The storage case has a transparent cover extending to cover the sharp and pointed portions of the displayed cutlery. The storage case further has a pocket for supporting literature descriptive of the displayed and stored cutlery.

BRIEF DESCRIPTION OF THE DRAWING

The preferred embodiment of the present invention is the display case disclosed in the detailed description and drawing. The drawing includes twelve figures to illustrate the preferred embodiment. The figures are briefly described as follows:

FIG. 8 is a perspective view of the top of a representative cutlery support block;

FIG. 9 is a perspective view of the bottom of the representative cutlery support block;

FIG. 10 is a front view of the support block in FIGS. 8 and 9;

FIG. 11 is a bottom view of the support block shown in FIGS. 8, 9, and 10;

FIG. 12 is a front, cross-sectional view of the cutlery support block shown in FIGS. 8, 9, 10, and 11 taken along line 12—12 of FIG. 11.

In the detailed description, directional terms such as upper, lower, and the like, are used to relate the invention to the normal orientation of a retail sale display. Terms of this type are used for the convenience of the person of ordinary skill in the art, and are not to limit the scope of any patent issuing on the present invention, unless included in the claims.

DETAILED DESCRIPTION OF THE PREFERRED EMBODIMENT

Figure 1:
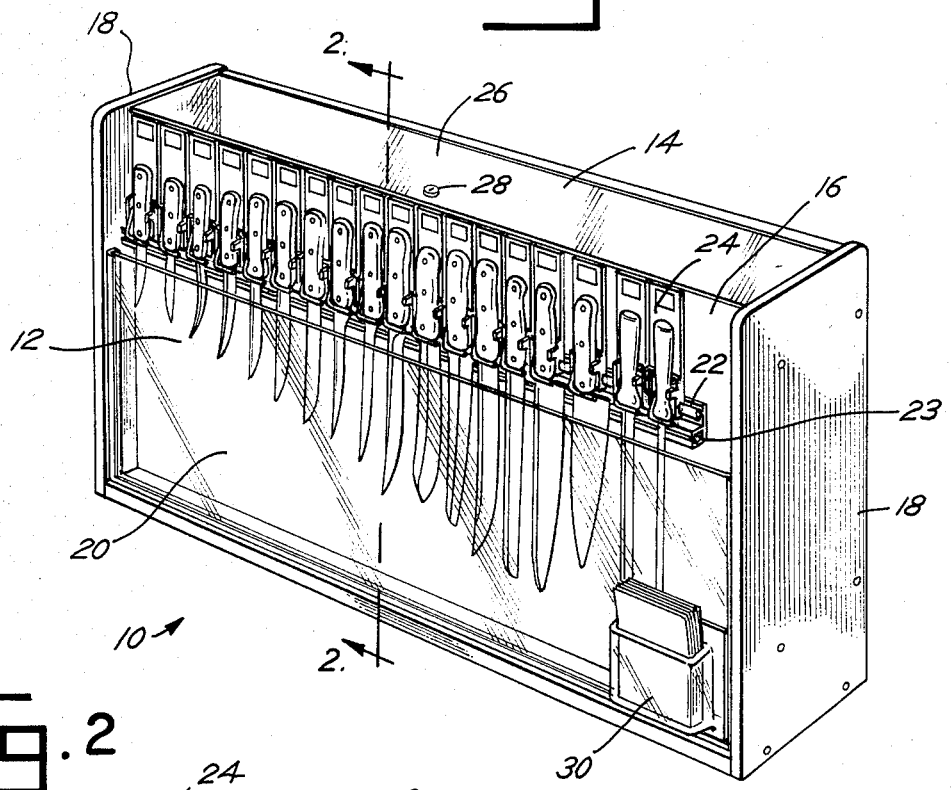
FIG. 1 is a perspective view of the preferred display case showing a variety of cutlery supported in a display position, and descriptive literature positioned in a display pouch.

Referring to the drawing, and particularly to FIG. 1, the preferred embodiment is a display case 10. The display case 10 has a forward display portion 12 and a rear storage portion 14. The two portions are connected by a divider 16, and are supported by side supports 18. The lower portion of the front storage area 12 is covered by a transparent cover 20. The transparent cover 20 comprises a sheet of transparent plastic supported on both sides by the side supports 18. Still referring to FIG. 1, display of cutlery in the preferred embodiment is accomplished through use of a T-shaped tongue rail 22 affixed to the divider 16. A positioning rail 23 is mounted on the divider 16 to act as a body against which cutlery may rest. A plurality of cutlery supports, such as representative support 24, are mounted onto the tongue rail 22. Each cutlery support 24 is mounted by tongue and groove insertion of the tongue rail 22 into a groove in the rear of the cutlery support 24. A top cover 26 covers the rear storage area 14. A lock 28 secures the top cover 26 in position over the rear storage area 14. A literature pouch 30 is attached to the transparent cover 20.

Figure 2:
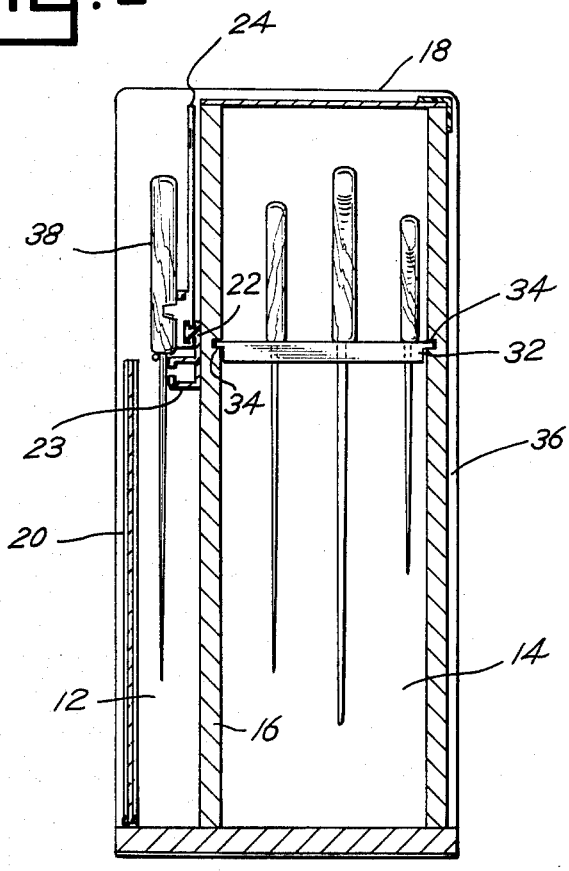
FIG. 2 is a side, cross-sectional view of the display case shown in FIG. 1 taken along line 2—2 of FIG. 1.

Referring now to FIG. 2, support of cutlery in the rear storage portion 14 is accomplished through a cutlery storage block 32 mounted in grooves 34 set into the divider 16 and rear support 36 of the display case 10. As FIG. 2 shows, a substantial number of cutlery pieces may be stored in line in the rear storage portion 14 behind the divider 16. FIG. 2 also illustrates that the transparent cover 20 extends upwardly a sufficient distance to cover the points and edges of the displayed cutlery 38.

Figure 3:
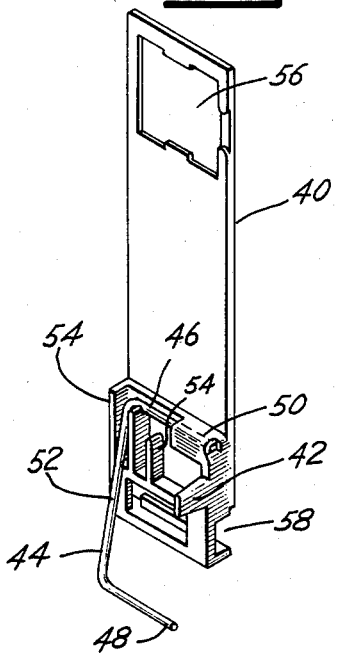
FIG. 3 is a perspective view of a representative support clip of the preferred display case having a U-shaped support arm, in a first support position, and used to support cutlery and related items in a display position.

Referring now to FIG. 3, the cutlery support 24 generally includes a backplate 40, a positioning tab 42, and a support clip 44. The support clip 44 is a U-shaped wire clip, with an upper end 46 and a parallel lower end 48. The upper end 46 is pivotably inserted into a sleeve 50 of the support 24. The upper end 46 and lower end 48 of the support clip 44 are connected by a connecting segment 52, which is positioned by placing it between one or more guide flanges 54 on the support 24. The backplate 40 includes a message receptacle 56, in which information descriptive of the cutlery supported by the cutlery support 24 may be inserted. Finally, the cutlery support 24 includes a groove 58 for tongue and groove mounting of the receptacle on the divider 16.

Figure 4:
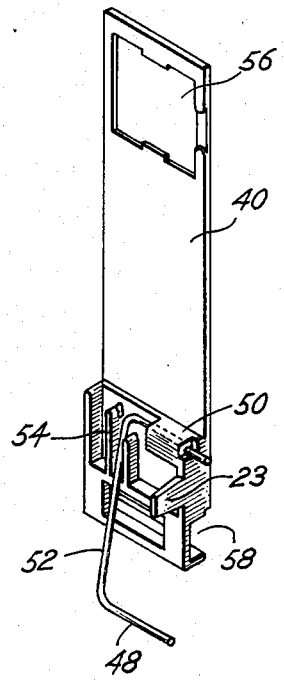
FIG. 4 is a second, perspective view of the support clip, with the support arm in a second support position.
Figure 5:
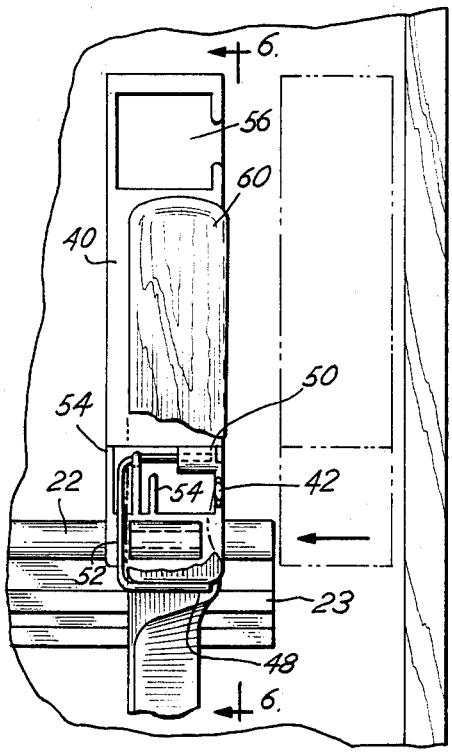
FIG. 5 is a front cutaway illustration of cutlery mounted in the support clip with the support clip mounted on the display case.
Figure 6:
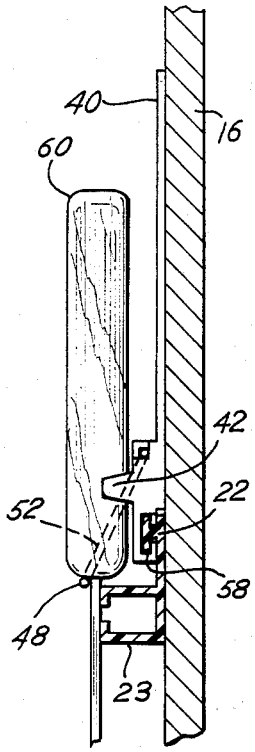
FIG. 6 is a side, cross-sectional view of the support clip with attached cutlery mounted on a display case taken along line 6—6 of FIG. 5.

Use of the cutlery support 24 in conjunction with cutlery and the divider 16 is illustrated in FIGS. 4, 5, and 6. As shown in FIG. 6, an item of cutlery 60 is supported by the lower end 48 of the support clip 44, and positioned by the positioning rail 23, positioning tab 42, and connecting segment 52. The groove 58 is fitted over the T-shaped tongue rail 22, thereby securing the backplate 40 flush against the divider 16.

As shown in FIGS. 4 and 5, the connecting segment 52 of the support clip 44 may be placed in different positions between the guide flanges 54 to accomodate different sizes and configurations of cutlery. Hence, the upper end of supported cutlery 60 is always securely held between the various parts, i.e. the support clip 44, the positioning tab 42, and the positioning rail 23.

Figure 7:
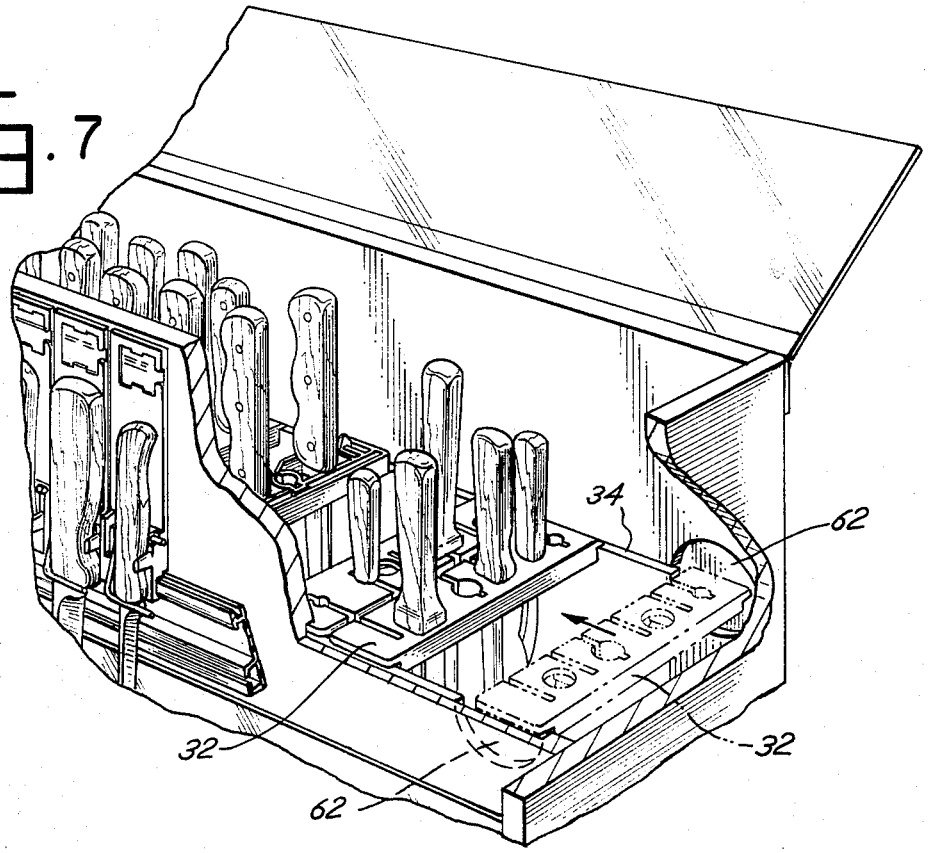
FIG. 7 is a cutaway perspective view of the display case showing installation and use of rear cutlery support blocks.

Referring now to FIG. 7, installation and use of the storage blocks 32 is illustrated. As also illustrated in FIG. 2, grooves 34 leading from openings 62 in the rear support 36 and divider 16 support a plurality of storage blocks 32. The storage blocks 32 are inserted into the grooves 34 by first placing the blocks 32 in the openings 62 and then sliding them to an appropriate position behind the divider 16.

Referring now to FIGS. 8 through 12, the preferred embodiment of the storage block 32 is shown. Generally, the block 32 consists of a molded plastic block having a plurality of slots 64 transverse to the longer dimension of the block. Additionally, the storage block 32 has a plurality of generally circular passageways 66, either bisected by the grooves 64, or placed between the grooves 64. The diameter of the passageways 66 and the width of the grooves 64 are both less than the width of handles for cutlery and related items, so that such cutlery or items can be inserted into the block 32 and be supported by the block 32.

FIGS. 10 and 11 illustrate additional support features of the support block 32. The bottom of the block 32 has a plurality of protruding lips 68 to provide additional support to the handle of stored cutlery if the storage block 32 is placed in the grooves 34 in an inverted position. Also, the storage block 32 has a pair of tongues 70 for tongue and groove insertion into the grooves 34 in the rear support 36 and divider 16. Moreover, the bottom of the support block 32 has a plurality of square or circular recesses 72 providing support for cutlery and related items having a variety of handle shapes. Hence, referring to FIG. 11, the recesses may be circular as in 74, generally square as in recess 76, or rectangular as in recess 78. The recesses 72 are configured to variously match or surround the slots 64 and passageways 66 in the support block 32. A single support block 32 is therefore able to adapt to and support with stability a wide variety of cutlery handle shapes, so that merchants storing cutlery and related items in the storage block area of the display case will be able to adapt the stored cutlery selection to the items most popular with customers.

While the preferred embodiment of the present invention has been set forth in the above detailed description, it is to be understood that the preferred embodiment is only an example of the invention. Other modifications may be used without departing from the scope of the present invention, and the invention is limited only by the following claims, including equivalents of elements of the claims where appropriate.

What is claimed is:

1. A display case for exhibiting cutlery or similar articles comprising, in combination:

a container having a forward display portion and a rearward storage portion;

a divider separating the forward and rearward portions;

means for carrying cutlery in the rearward storage portion, said means comprising a plurality of slotted blocks mounted within the rearward storage portion, the slotted blocks being slidably insertable within the rearward storage portion of the display case;

means for supporting cutlery on the divider, said means mounted on the divider and comprising a cutlery support frame having a groove, and a complementary tongue affixed to the divider, the tongue being T-shaped in cross-section and the groove being T-shaped in a size complementary to the T-shaped tongue; and a transparent cover for the forward display portion positionable on the container, the transparent cover screening the sharp portions of the displayed cutlery, the transparent cover further comprising a generally transparent sheet slidably attached to the container forward of both the divider and the means for supporting cutlery on the divider.

2. A display case as claimed in claim 1, wherein the container further comprises a lockable lid for the rearward storage means, and a pouch mounted on the transparent cover for holding descriptive literature.

3. A cutlery receptacle for supporting cutlery in a display position, the cutlery being of the kind having a relatively thick grip portion, a relatively thin functional portion and a shelflike connection therebetween, the cutlery receptacle comprising, in combination:

a bracket having a generally vertical backplate with a generally horizontal positioning tab extending therefrom, the bracket further having an integral frame for mounting an information bearing label;

a support clip pivotally attached at one end to the bracket and hanging from the bracket by the pivotally attached end, the support clip having a surface remote from the pivot attachment and below the tab for supporting cutlery at the cutlery's shelflike connection, the support clip further having a support arm with a lower, hooked finger and an upper connecting segment, the connecting segment being mounted to the bracket for pivotal movement of the support clip about the upper connecting segment, the lower finger extending generally downward from the connecting segment parallel to the supported cutlery and then hooking underneath the cutlery's shelflike connection, the support arm also having a generally U-shaped support wire, with the open side of the U facing the positioning tab side of the bracket, the upper side of the U-shaped support wire inserted into the bracket parallel to the bracket surface for pivotal movement of the U-shaped support wire about the wire's upper side, the base of the U extending downwardly from the upper side of the U-shaped support wire generally parallel to the supported cutlery, and the lower side of the U-shaped support wire extending underneath the cutlery grip to support the cutlery;

the bracket further comprising one or more guide flanges for positioning the downward extending portion of the lower hooked finger, and having one or more projecting guide flanges affixed to the bracket substantially parallel to the cutlery for positioning the base portion of the U-shaped clip; and means for mounting the bracket on a vertical surface.

4. A cutlery storage block, comprising, in combination:

an elongated block defining a plurality of slots in the block thin relative to handles of cutlery or related items and oriented transverse to the direction of block elongation, the block further defining a plurality of passageways through the block parallel to the slots, the interface of the passageways and slots with the block surface being substantially planar, the interface defining at least one flat side of the block, and the axis of one or more passageways corresponding with a slot;

a pluality of positioning lips extending from the block between the slots, transverse to the direction of block elongation the positioning lips tapering from thick to thin away from the block in a direction transverse to the slots, thereby forming a guide for cutlery handles; and support surfaces on each end of the elongated block, the support surfaces having tongues mateable with complementary grooves in a display case.

5. A display case for exhibiting cutlery or similar articles, the cutlery being of the kind having a relatively thick grip portion, a relatively thin functional portion and a shelflike connection therebetween, comprising, in combination:

a container having a forward display portion and a rearward storage portion;

a divider separating the forward and rearward portions;

means for carrying cutlery in the rearward storage portion, the means positioned within the rearward storage portion and comprising a plurality of slotted blocks mounted within the rearward storage portion, the slotted blocks being slidably insertable within the rearward storage portion with each slotted block comprising an elongated block defining a plurality of slots in the block that are thin relative to handles of cutlery or related items and are oriented transverse to the direction of block elongation, the block further defining a plurality of passageways through the block parallel to the slots, the interface of the passageways and slots with the block surface being substantially planar and defining at least one flat side of the block, the axis of one or more passageways corresponding with a slot, each block having a plurality of positioning lips extending from the block between the slots transverse to the direction of block elongation, the positioning lips tapering from thick to thin away from the block in a direction transverse to the slots, thereby forming a guide for cutlery handles;

means for supporting cutlery on the divider, said means mounted on the divider and comprising a cutlery support frame having an attachment groove, and a complementary tongue affixed to the divider, the tongue being T-shaped in cross-section and the groove being T-shaped in a size complementary to the T-shaped tongue, the cutlery support frame having a bracket with a generally vertical backplate and a generally horizontal positioning tab extending therefrom;

a support clip pivotally attached at one end to the bracket and hanging from the bracket by the pivotally attached end, the support clip having a surface remote from the pivot attachment and below the tab for supporting cutlery at the cutlery's shelflike connection, the support clip further having a support arm with a lower, hooked finger and an upper connecting segment, the connecting segment being mounted to the bracket for pivotal movement of the support clip about the upper connecting segment, the lower finger extending generally downward from the connecting segment parallel to the supported cutlery and hooking underneath the cutlery's shelflike connection, the support arm having a generally U-shaped support wire, with the open side of the U facing the positioning tab side of the bracket, the upper side of the U-shaped support wire inserted into the bracket parallel to the bracket surface for pivotal movement of the U-shaped support wire about the wire's upper side, the base of the U extending downwardly from the upper side of the U-shaped support wire generally parallel to the supported cutlery, and the lower side of the U-shaped support wire extending underneath the cutlery grip to support the cutlery;

the bracket further comprising one or more guide flanges for positioning the downward extending portion of the lower hooked finger, the bracket also having one or more projecting guide flanges affixed to the bracket substantially parallel to the cutlery for positioning the base portion of the U-shaped clip;

means for mounting the bracket on a vertical surface; and a transparent cover for the forward display portion positionable on the container, the transparent cover screening the sharp portions of the displayed cutlery, and the transparent cover further comprising a generally transparent sheet slidably attached to the container forward of both the divider and the means for supporting cutlery on the divider.

6. A display case as claimed in claim 5, wherein the base of the U-shaped support wire may be located in a plurality of discrete positions, whereby cutlery of a variety of grip sizes may be retained by the support arm.

* * * * *